US007676859B2

(12) United States Patent
Brossier

(10) Patent No.: US 7,676,859 B2
(45) Date of Patent: Mar. 16, 2010

(54) FOLDING BED WITH SCISSORS-TYPE LIFTING ARRANGEMENT

(75) Inventor: Jean Brossier, Coulaines (FR)

(73) Assignee: Sedac-Mecobel S.A., Wevelgem (BE)

( * ) Notice: Subject to any disclaimer, the term of this patent is extended or adjusted under 35 U.S.C. 154(b) by 4 days.

(21) Appl. No.: 11/995,760

(22) PCT Filed: Jul. 14, 2006

(86) PCT No.: PCT/EP2006/006909

§ 371 (c)(1),
(2), (4) Date: Jul. 7, 2008

(87) PCT Pub. No.: WO2007/009671

PCT Pub. Date: Jan. 25, 2007

(65) Prior Publication Data

US 2008/0263765 A1 Oct. 30, 2008

(30) Foreign Application Priority Data

Jul. 15, 2005 (DE) ..... 10 2005 033 053

(51) Int. Cl.
*A47C 17/22* (2006.01)
*A47C 14/04* (2006.01)

(52) U.S. Cl. ..... 5/13

(58) Field of Classification Search ..... 5/13, 5/14, 16
See application file for complete search history.

(56) References Cited

FOREIGN PATENT DOCUMENTS

GB 769599 3/1957

*Primary Examiner*—Alexander Grosz
(74) *Attorney, Agent, or Firm*—Browdy & Neimark, PLLC

(57) ABSTRACT

The invention relates to a folding bed which is covered with a mattress (9) and comprises a head frame, back frame and foot frame (8, 7, 6) which are connected to one another in an articulated manner and are arranged in a collapsed state in a basic frame (1) or box such that they can be raised and lowered by means of a lifting mechanism (4), in which case the lifting mechanism (4) comprises scissors-type lifting arrangements which are provided on both sides of the head frame (8), are spring-loaded for lifting action, and have their top ends articulated on the end sides of the head frame (8), and that the first scissors arm (47) is articulated, at the top end, on a short block link (43) at the back-part head-frame end at an articulation (44) on which acts a link plate (42) which is connected in an articulated manner to a control arm (41) and is connected to a spacing head-frame connector (20) of the head frame (8) and of the back frame (7). Supporting legs and catches secure the end positions; claddings prevent access to movable parts and springs.

26 Claims, 14 Drawing Sheets

F
C
6
7
22
9
10
21
11
12
D
21A
8
T
13
15
14
19
20
16
17
18

A
9
6
7
22
14
19
17
8
18
16
20
15
13
12
11
10
21

FOLDING BED WITH SCISSORS-TYPE LIFTING ARRANGEMENT

The invention relates to a folding bed, which is covered with a mattress and comprises a head frame, back frame and foot frame, which are connected to one another in an articulated manner and are arranged in a collapsed state in a basic frame or box such that they can be raised and lowered by means of a lifting mechanism, Such known folding beds usually have on both sides of the basic frame respectively a four-bar linkage, which require a tilting of the bed when it is lifted or lowered, and therefore have a considerable requirement for space in and around the basic frame.

It is the object of the invention to create a safe lifting and folding mechanism with a fixed mattress, which is most compact to stow away in the basic frame.

This object is met in such a way, that the lifting mechanism comprises scissors-type lifting arrangements, spring-loaded for lifting action, which are provided on both sides of the head frame respectively, a first scissors arm of each lifting arrangement being articulated, at the bottom end, on the basic frame, where a horizontally movable second scissors arm is supported, the top end of which is articulated at the end of the head frame, and that the first scissors arm is articulated, at its top end, on a short block link at the back-part head-frame end with an articulation on which acts a link plate which is connected in an articulated manner to a control arm and is connected to a spacing head-frame connector of the head frame and of the back frame, and is arranged in such a way, that when the head frame connector is brought to a horizontal position, the block link is in a dead-centre position of the scissors articulation, and that when the connector is in an inclined position the block link is lead out from the dead-centre position, so that the lifting mechanism holds the head frame in a lowered position.

Advantageous forms of the invention are indicated in the subclaims.

The block link has such a length that in the case of a rotation of approximately 180° the scissors-type lifting arrangement is moved from the upper position, in which the bed is used, to the recessed bottom position. Correspondingly, the control arm is longer, which actuates the full lifting movement when it is rotated by 90°. The horizontal component of the tentile force secures the locking position of the block link.

The spacing connector between the head frame and the back frame has a length that corresponds to approximately the double thickness of the mattress, which is folded when the bed is lowered.

Similarly, there is another spacing connector between the back frame and the foot frame, which however is much shorter, because the mattress is folded around this connection on the outside.

To ensure a smooth folding of the three frames, the two connectors are connected via a control rod in such a way that the two frame articulation arrangements respectively form approximately the same angle. For this purpose the control rod is articulated at the two connectors respectively, spaced to the articulation of the back frame, so that a controlling four-bar linkage is formed.

The four-bar linkage is preferably shaped in such a way that in the collapsed state the articulation of the control rod at the foot frame connector crosses the connecting line between the neighbouring articulation of the foot frame connector at the back frame and the other articulation of the control rod, thus keeping the mattress from unfolding because of the pressure of the compressed areas. Only when the bottom end is lifted, the blocking is released by shifting the articulation at the foot frame connector back across the above-mentioned line and thus pulling the control rod.

The folding of the connectors is advantageously supported by a spring, which is pre-tensioned and arranged between the back frame and the head frame connector.

The mattress is advantageously held at the head and bottom end with a tuck in an undercut slot profile, especially at the head and foot frame, by means of a bar inserted into the tuck, whose diameter is larger than the width of the outlet of the slot. This way the mattress or its supporting covering always remains leveled with the frames when the frames are folded and covers the fitting parts, such as springs, control rods, scissors and supporting legs towards the top. On the side of the frames, only the articulation bolt heads and the connectors are accessible, thus in this area there is no danger of pinching or crushing for the user as well. The scissor arms and the blocking mechanics are locked in the lying position of the bed, and thus secured. Folding and unfolding of the frames is effectuated by seizing and lifting the free bottom end, so that there is no risk of collision with the basic frame and the scissors-type lifting arrangement.

Bearing racks are arranged at the bottom end and at the head frame connector, each bearing rack consisting of two legs and a cross brace. The legs are attached to the head frame connector, so that they automatically come to lie between the head frame and the back frame during a folding operation. The legs at the bottom end are either attached firmly to the frame or pivoted in articulation heads at the foot frame with two bolts leading around a corner in an angled motion link. The bolts are attached at a distance to the upright leg, and the side pieces of the motion link are slightly longer than the extension of the spaced bolts, this way the mechanism is secured against tilting with a lateral load, both in the angled and in the parallel position of the legs in relation to the foot frame. The higher the load on the frames, the more they are secured. When the bottom end of the bed is lifted, the legs sink from the security position, thus they can easily be rotated manually into the folded parallel position. The folding and unfolding of the bearing rack is done advantageously when the foot frame is lifted. In the parallel position of the legs in relation to the foot frame, there is an open space between the legs, so that there is no risk of pinching.

The entire arrangement, in all its details and during all folding processes, is completely safe and, since minimum spacing between the moving parts is observed, the risk of crushing and thus injuring hands and fingers is avoided. In addition, there is no uncontrolled retraction or extension and no risk of shearing in the range of the articulations. In the unfolded lying position no frame parts extend above the so that there is no edge for a sleeper to knock against. All parts are interlocked in an immobile position when the bed is charged by persons in different ways.

In another embodiment the bed is provided with a basic frame, on the side frames of which the scissors-type lifting arrangements are articulated at the bottom side, respectively. The two side frames are interconnected by crossbars. The frames are made of angular material, into the vertical limbs of which hook-in eyelets are placed, to attach cushion armrests, a front panel and a backrest. The two legs at the bottom end fit between the side frames when the bed is folded, and stand on the inside at the front-side crossbar. Thus, the folded framework stands firmly in place.

To further increase the security of the framework position in the unfolded state, a boomerang-shaped or angular support angle is articulated on both sides, respectively between the vertical piece of the side frame at the bottom end and the head end of the back frame, said angle supporting the back frame at a lying level, in the same way as the legs.

The support angle is provided with an eyelet directed towards the scissors-type lifting arrangement, the scissors spring is hooked into said eyelet, which at the head end is connected with the scissors arm in an articulated manner. This way the scissors spring apart from the scissors also holds the support angle in the lying position.

Supports are arranged at the head end of the basic framework, on which the head frame is rests in the folded position. So this position, too, is stably supported by the legs at the other end and is not affected by the thickness of the cushioning, which increases its security.

Furthermore, an elastic locking fork is arranged at both sides of the bottom of the foot frame respectively, said fork encompassing a cross brace of the back frame in the folded state; in doing so it secures the state against independent unfolding. Moreover, a notch towards the side frame is provided at the end of the foot frame.

As a further security measure, the folding of the foot frame towards the back frame is restrained, on both sides respectively, by a damper, which is articulated, on one side, at the foot frame and, on the other side, at the foot frame connector.

The head and foot frame connectors are box-shaped with caps and cover the areas of the articulations as well as the articulation parts, which are moving and rotating in relation to each other, towards the outside.

In an advantageous embodiment the foot frame connector is made of plastic as a multifunctional component, into which bearing eyes, lever appendages and a leg connecting stud, as well as deepenings for a cover cap are integrated.

The attached backrest advantageously has a hollow shape, so it can be used for receiving blankets and pillows. Through a flap, which extends in the back area, the storage space is easily accessible.

Advantageous embodiments are represented in the FIGS. 1 to 26

Figure 15:
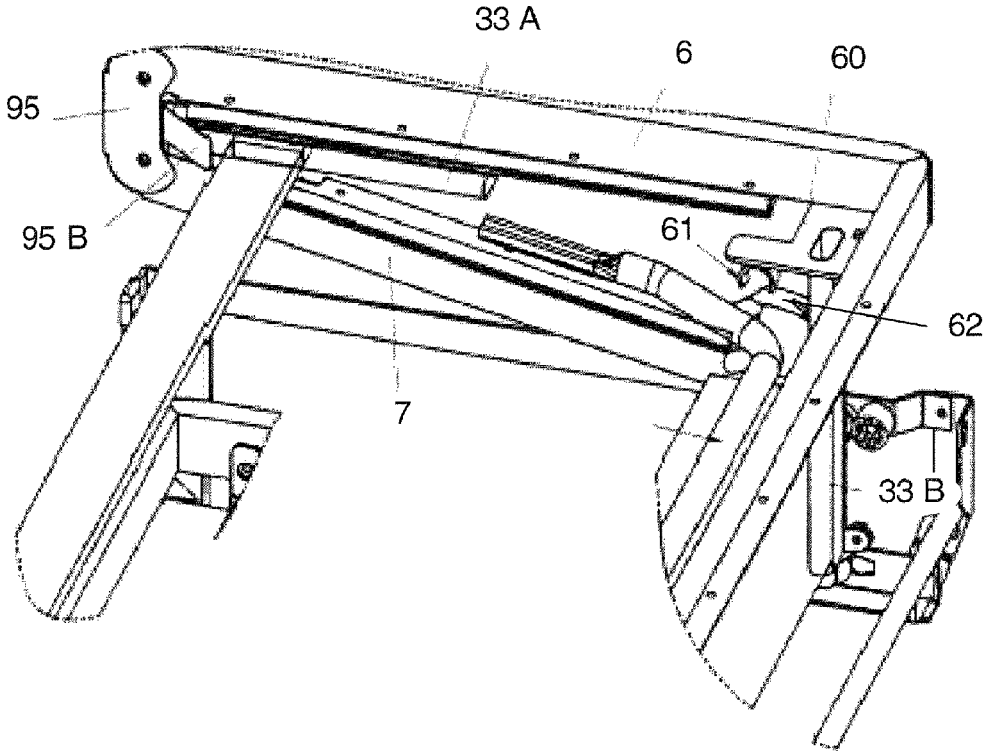
Figure 17:
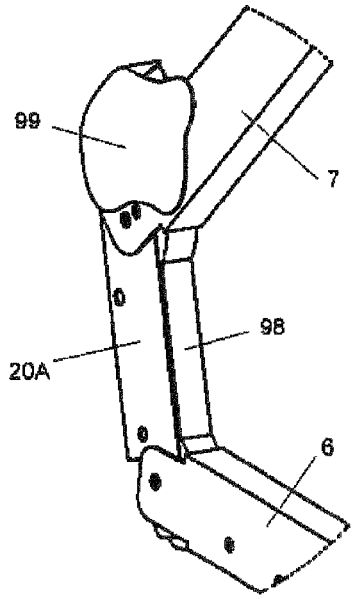
Figure 19:
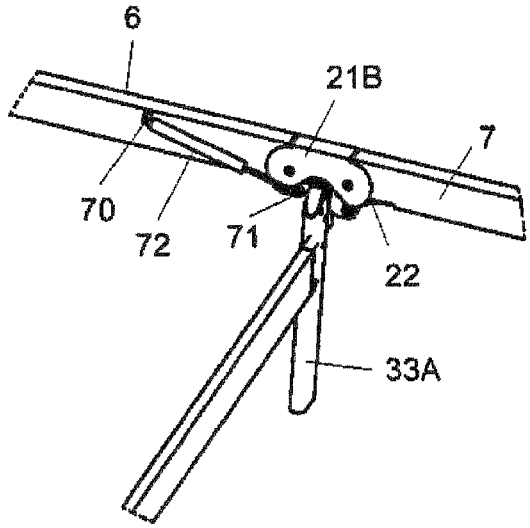
Figure 18:
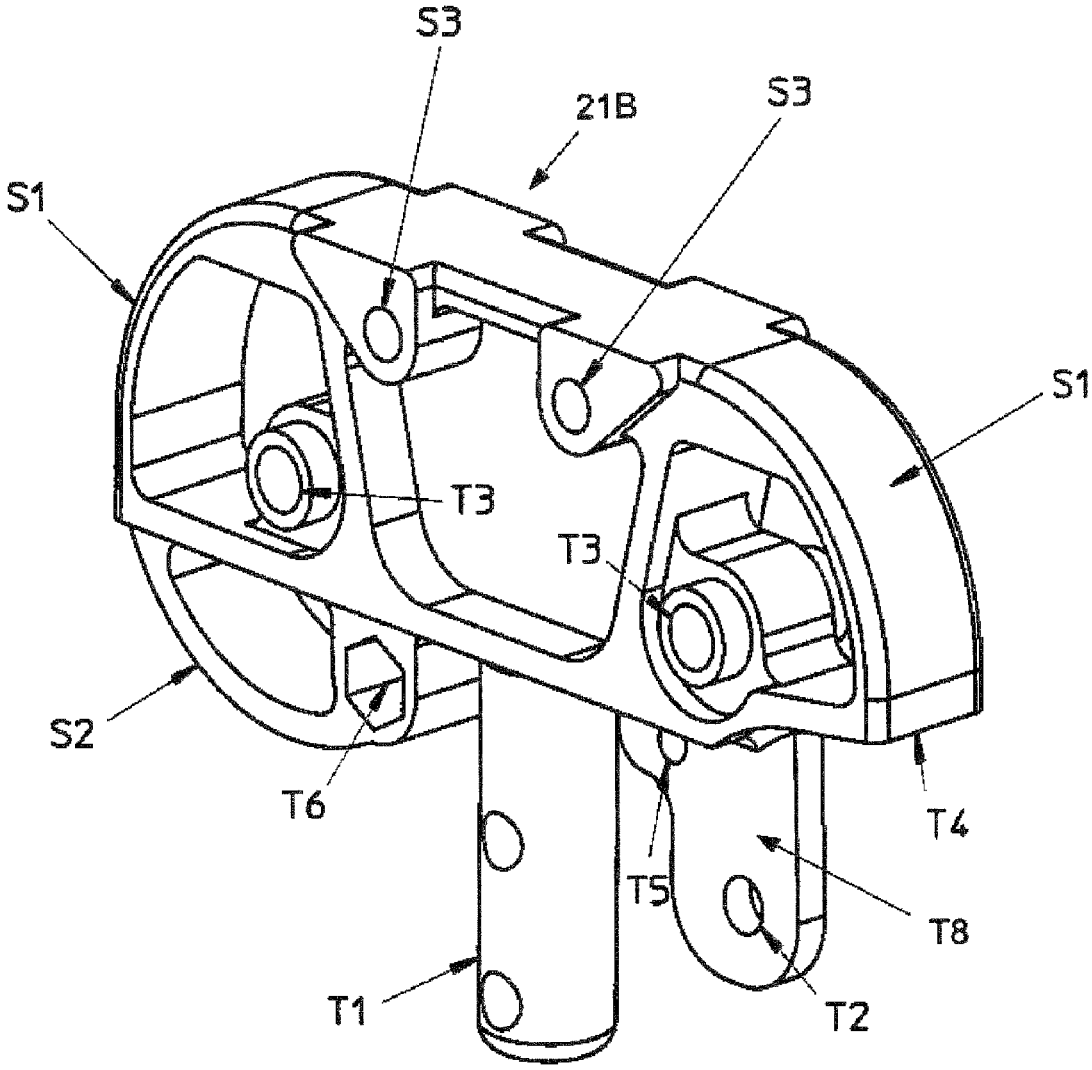
Figure 21:
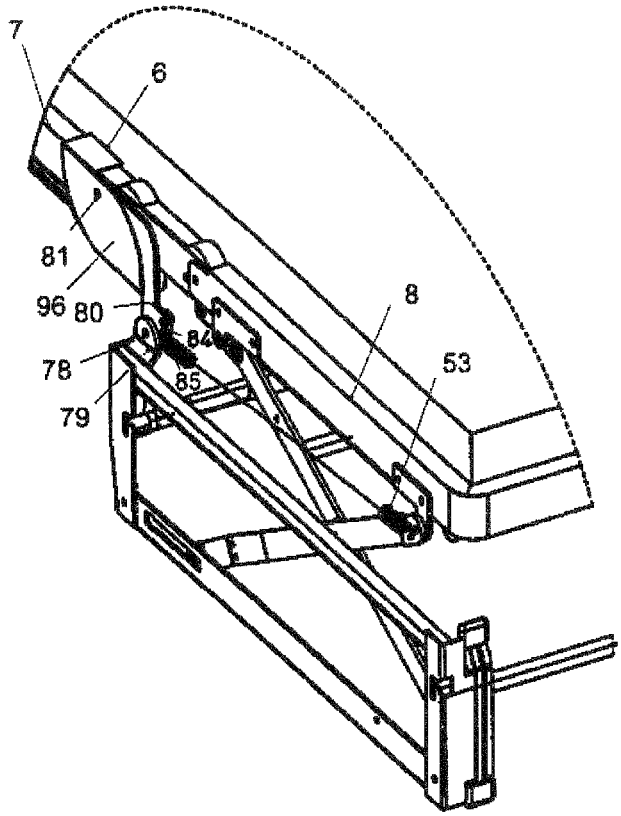
Figure 23:
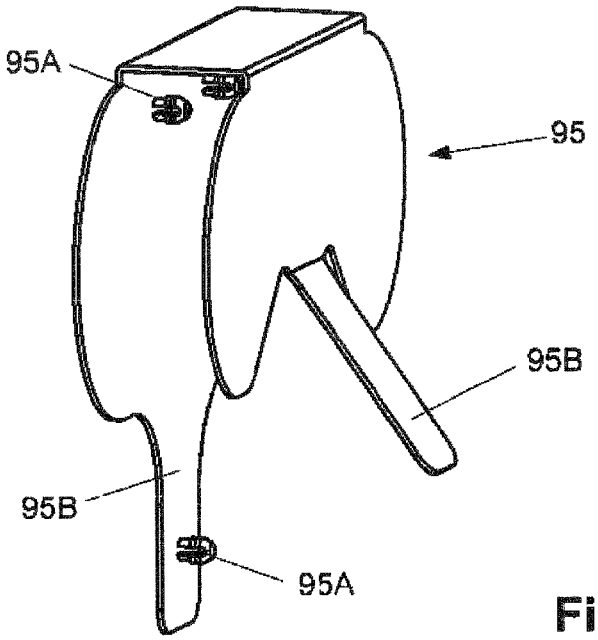
Figure 24:
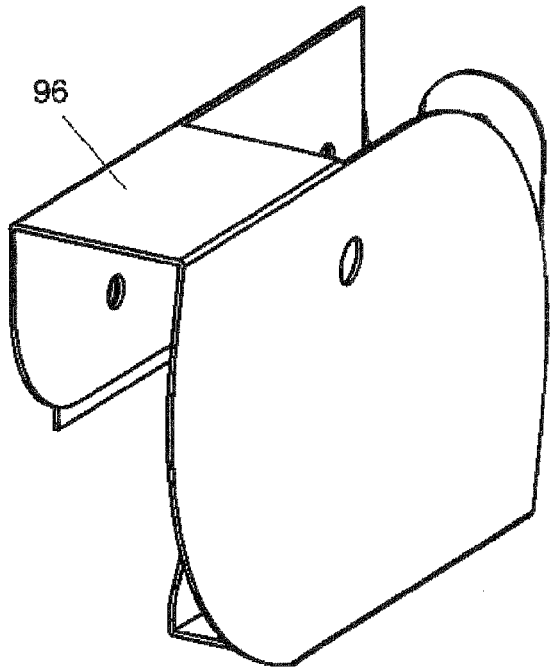
Figure 25:
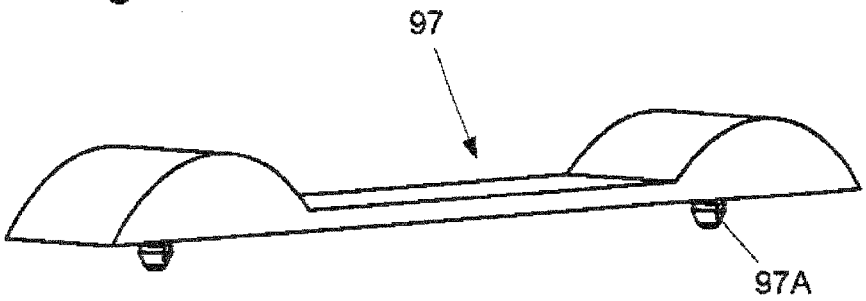
Figure 26:
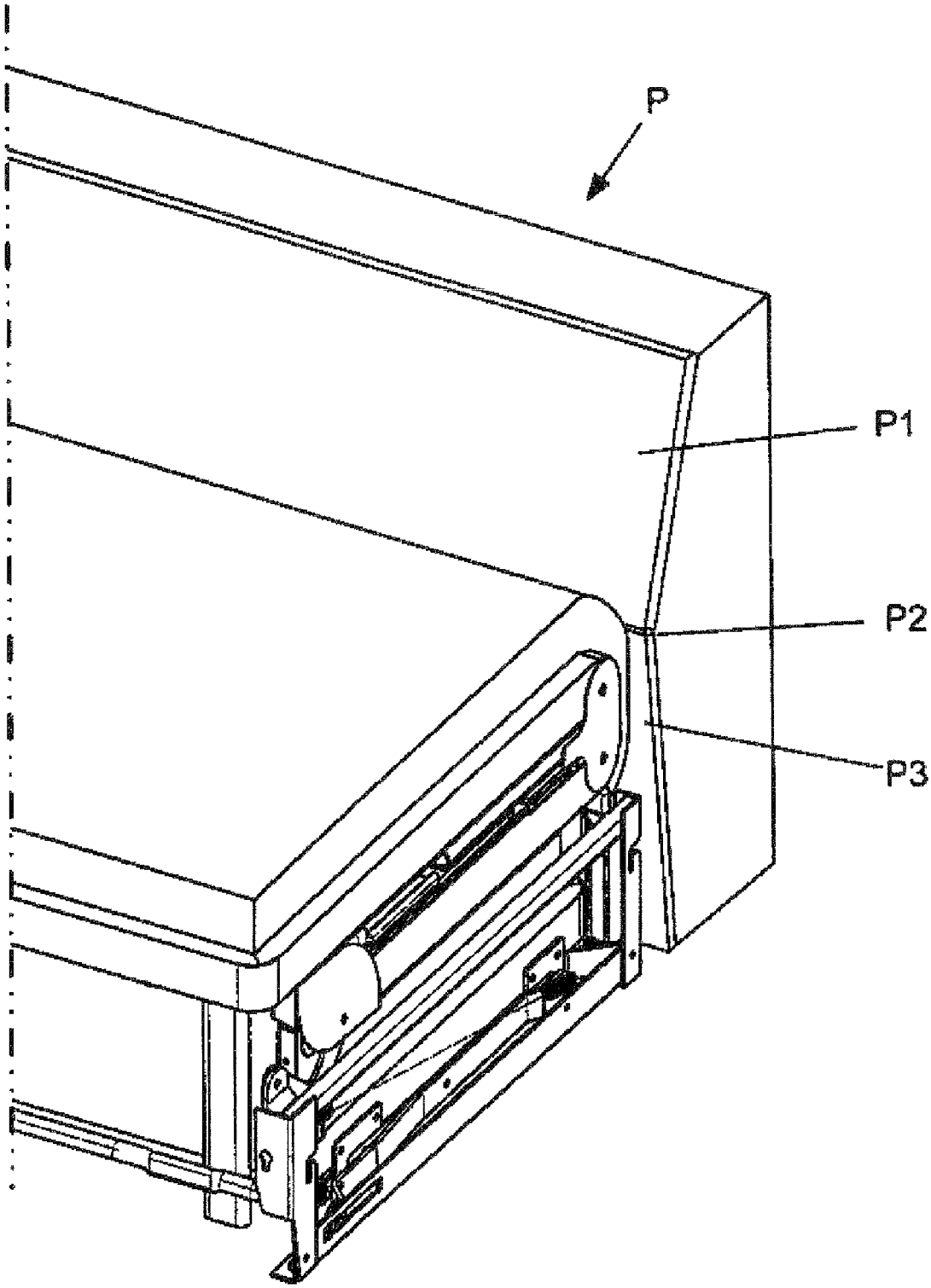

FIG. 15+16 each show a corner in a perspectively reduced view, one with the frame nearly folded, one with completely folded frame;

FIG. 17 shows an inclined interior view of a connector with cladding;

FIG. 18 shows a connector piece in perspective;

FIG. 19+20 show the foot frame connector with leg with unfolded and folded frame, respectively;

FIG. 21+22 show perspective side views unfolded and folded, respectively, view from the head end;

FIG. 23-25 show cladding pieces of the frame connectors;

FIG. 26 shows a folded bed with the backrest, armrest detached.

Figure 1:
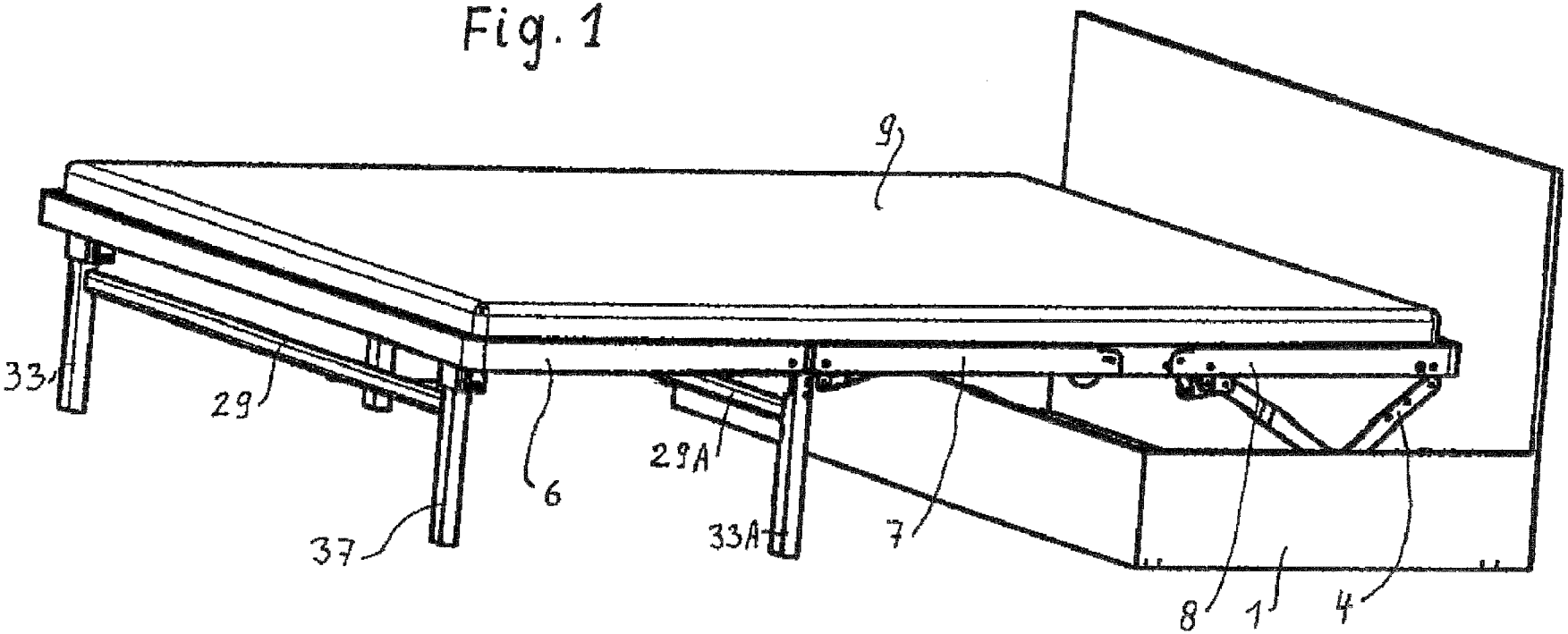
FIG. 1 shows a perspective general view of the folding bed unfolded.

FIG. 1 shows a perspective view of the unfolded bed, which consists of the head frame 8, the back frame 7 and the foot frame 6, which are connected in an articulated manner and covered with a mattress 9. The head frame rests on a scissors-type lifting mechanism 4, which is supported in a basic frame 1. The dress plates of the folding and lifting mechanism are arranged on both sides, symmetrical to the longitudinal axis. Bearing racks 3 with two legs 33, 33A and a cross brace 29, 29A each, are arranged between the back frame 7 and the foot frame 6 as well as at the bottom end of the foot frame.

Figure 2:
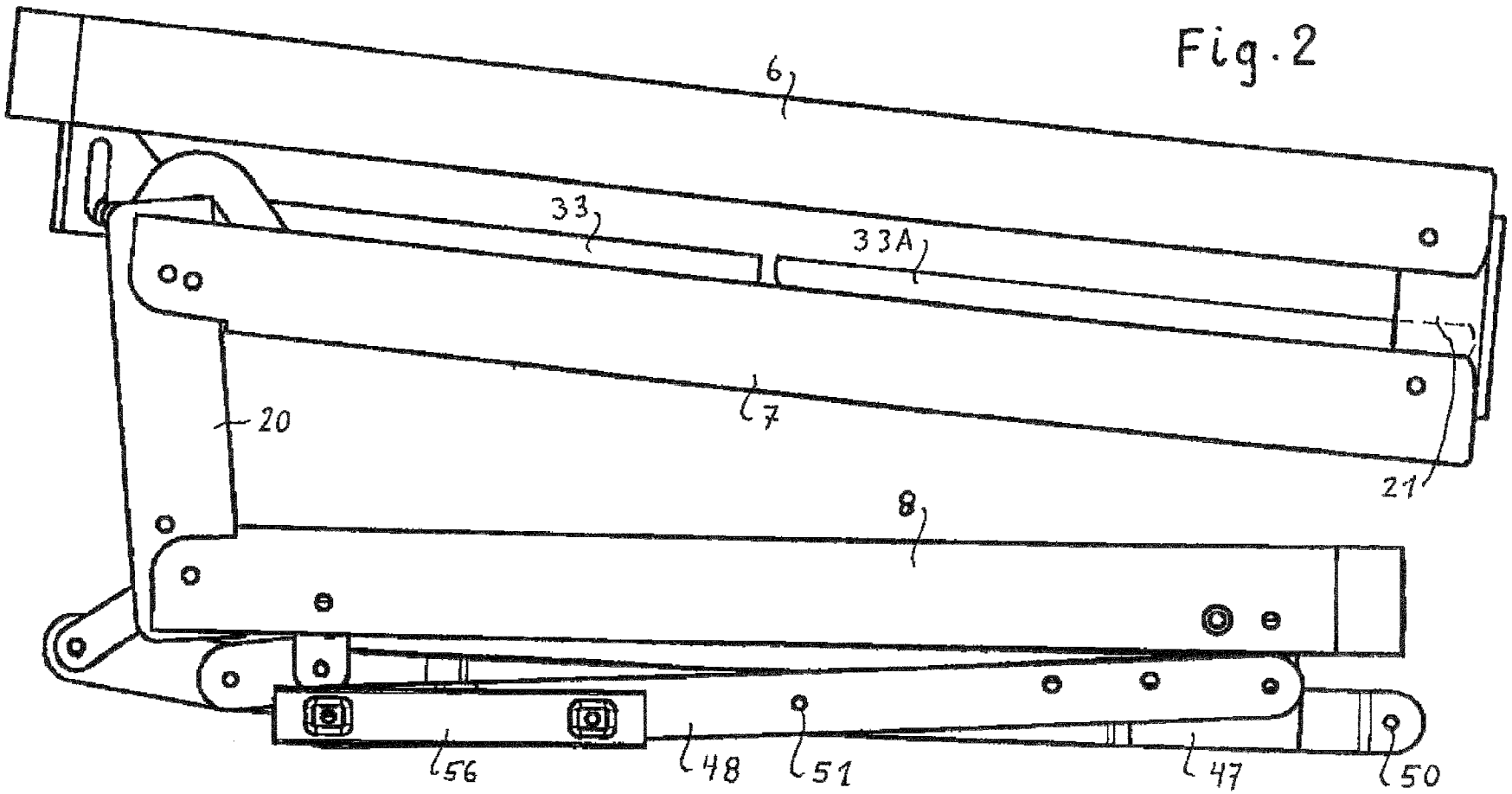
FIG. 2 shows a side view of the folded lifting mechanism.

FIG. 2 shows the folded lifting mechanism without mattress in a side view. One can see that one head frame connector 20 is arranged, respectively between the head frame 8 and the back frame 7, whereas between the back frame 7 and the foot frame 6, respectively one foot frame connector 21 is arranged in an articulated connection. In the folded state of the bed, these connectors 20, 21 are approximately perpendicular. The folded bearing rack with the legs 33 is arranged at the foot frame 6, the other bearing rack with the legs 33A is arranged at the foot frame connectors 21.

The completely folded scissors-type lifting arrangement consists essentially of the scissors arms 47, 48, which are connected in the scissor articulation 51. At the lower end of the first scissors arm 47 the articulation 50 is situated, by means of which the scissors are supported on the basic frame.

The second scissors arm 48 is articulated on a glider 56, which is guided in the basic frame horizontally movable.

Figure 3:
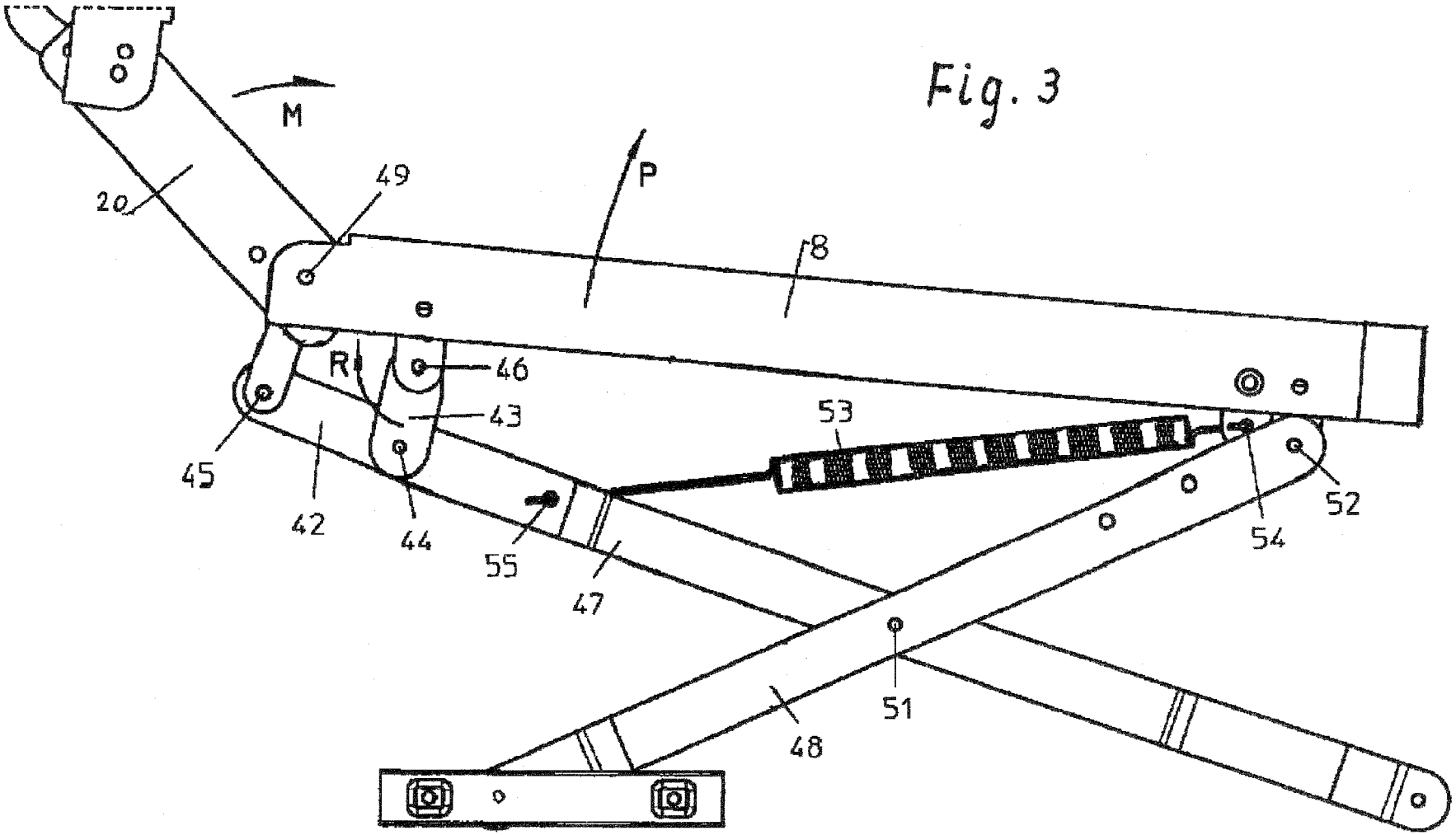
FIG. 3 shows a side view of the scissors-type lifting arrangement when lifting.

FIG. 3 shows a side view with the scissors-type lifting arrangement partly raised. A spring 53 is tensioned between the head end of the head frame 8 in the eyelet 54 and the first scissors arm 47 in the eyelet 55, said spring raising a lifting force as a counterforce to the weight of the bed and in such a way supporting the unfolding of the bed. The second scissors arm 48 is articulated at an articulation 52 laterally at the head end of the head frame 8, and the first scissors arm 47 is articulated at the articulation 44 via a link plate 42 in the articulation 45 at a short control arm 41, firmly connected with the head frame connector 20, which is connected with the head frame 8 in the articulation 49. Moreover, at the upper end of the first scissors arm 47 and offset from the articulation 49 a block link 43 is articulated at the articulations 44, 46, so that the articulations 49, 46, 44, 45 form a four-bar linkage.

Figure 4:
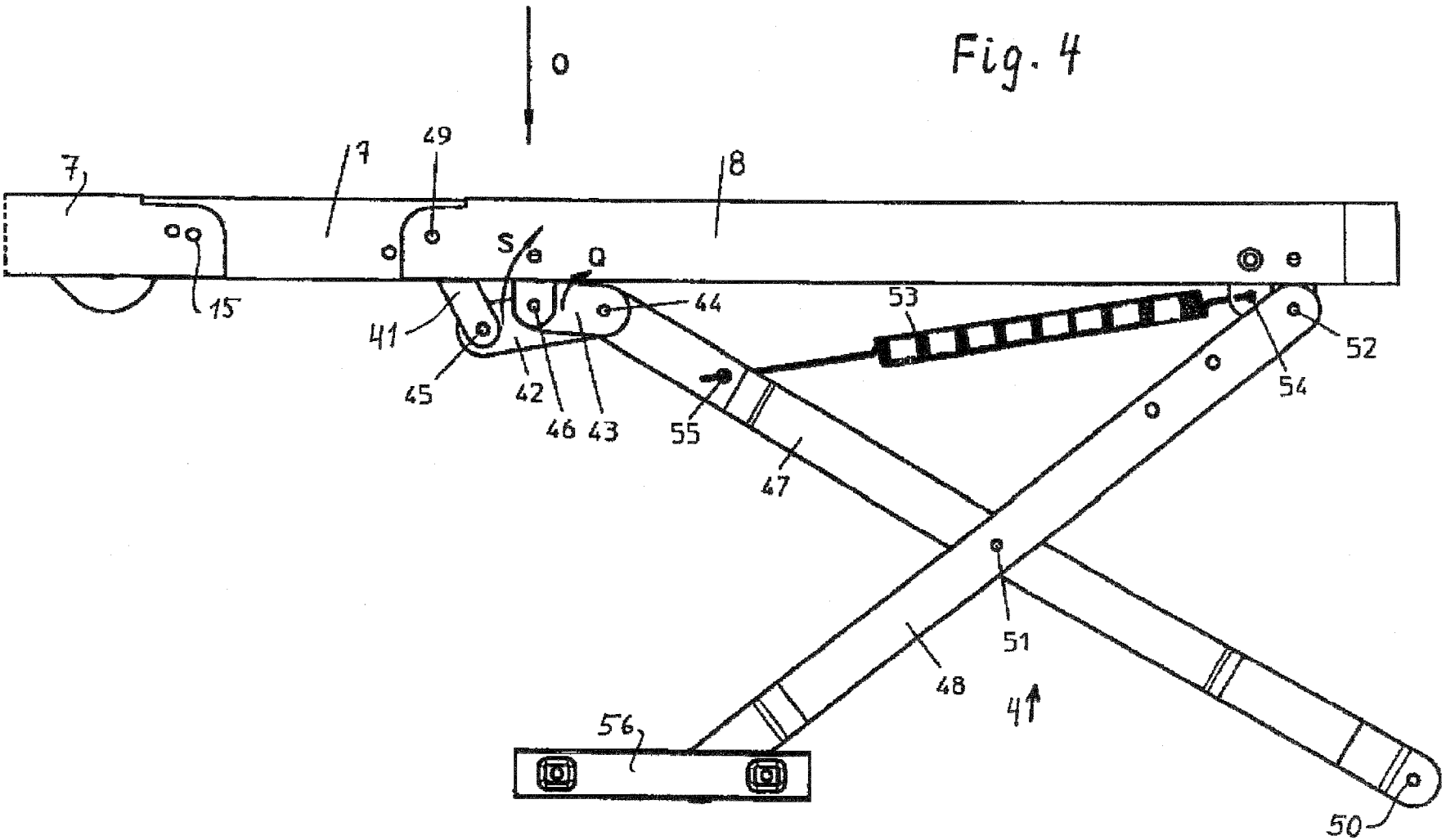
FIG. 4 shows a side view of the scissors-type lifting arrangement in maximum lifting position.

FIG. 4 shows, that in the upper position of the scissors-type lifting arrangement the block link 43 is positioned approximately parallel to the head frame 8 by means of a stop, and thus the articulation 44 is in a blocking position above the line, which connects the articulations 46, 50. The load 0 cannot release the lock; in addition the spring 53 takes effect in the blocking direction. Only a lifting of the back frame 7, and thus an upward turn in the direction of M, FIG. 3, of the head frame connector 20 releases the lock, because the articulation 46 of the block link 43 at the head frame 8 is positioned above the articulations 44, 45 of the link plate 42, which is actuated by the control arm 41.

Figure 5:
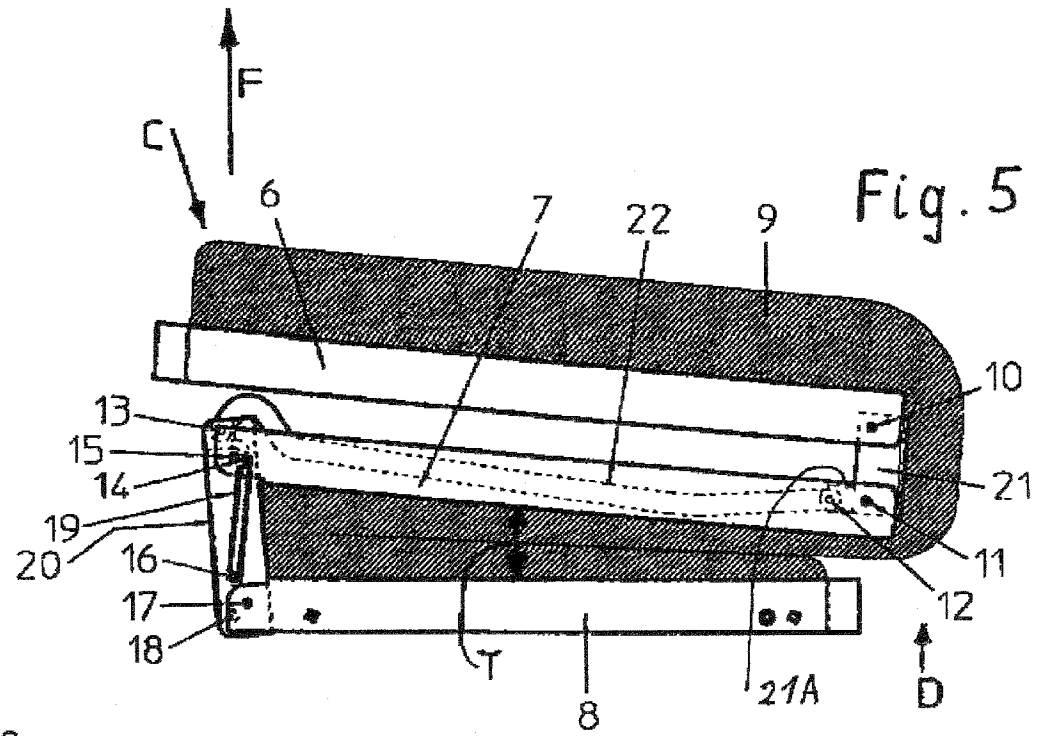
FIG. 5 shows a side view of the folded lifting mechanism with a part of a detail of a frame connector.

FIG. 5 shows the folded state of the frames 6, 7, 8 when covered with a mattress 9. At the left side a larger detail of the head frame connector 20 is shown, which in the articulations 17 and 15 is connected with the head frame 8 and the back frame 7 respectively. In addition a spring 19 acts in the eyelets 16, 14 between the connector 20 and the back frame 7 in the closing direction. The connector 20 creates a distance between the two frames 8, 7, which keeps space there for the folded mattress.

The foot frame connector 21, which in the articulations 10, 11 connects the foot frame 6 to the back frame 7 at a small distance, is long enough to prevent wedging of fingers between the two frames.

Roughly parallel to the back frame 7, a control rod 22 is articulated in the articulation 13 on the head frame connector 20 and in the articulation 12 at a short handlebar 21A on the foot frame connector 21. The connecting line between the articulations 11, 13 in the shown, folded position runs above the articulation 12, so this position is maintained stable against a counteracting pressure T of the mattress. Only an impact in the direction of C to the bottom end of the bed can bring the articulation 12 above the dead-centre position, so that afterwards lifting, by a movement in the direction of F, initiates the further unfolding, which is facilitated by the spring 19 and the control rod 22, because this rod affects the articulation 13 in a place offset from the folding articulation 15.

Figure 6:
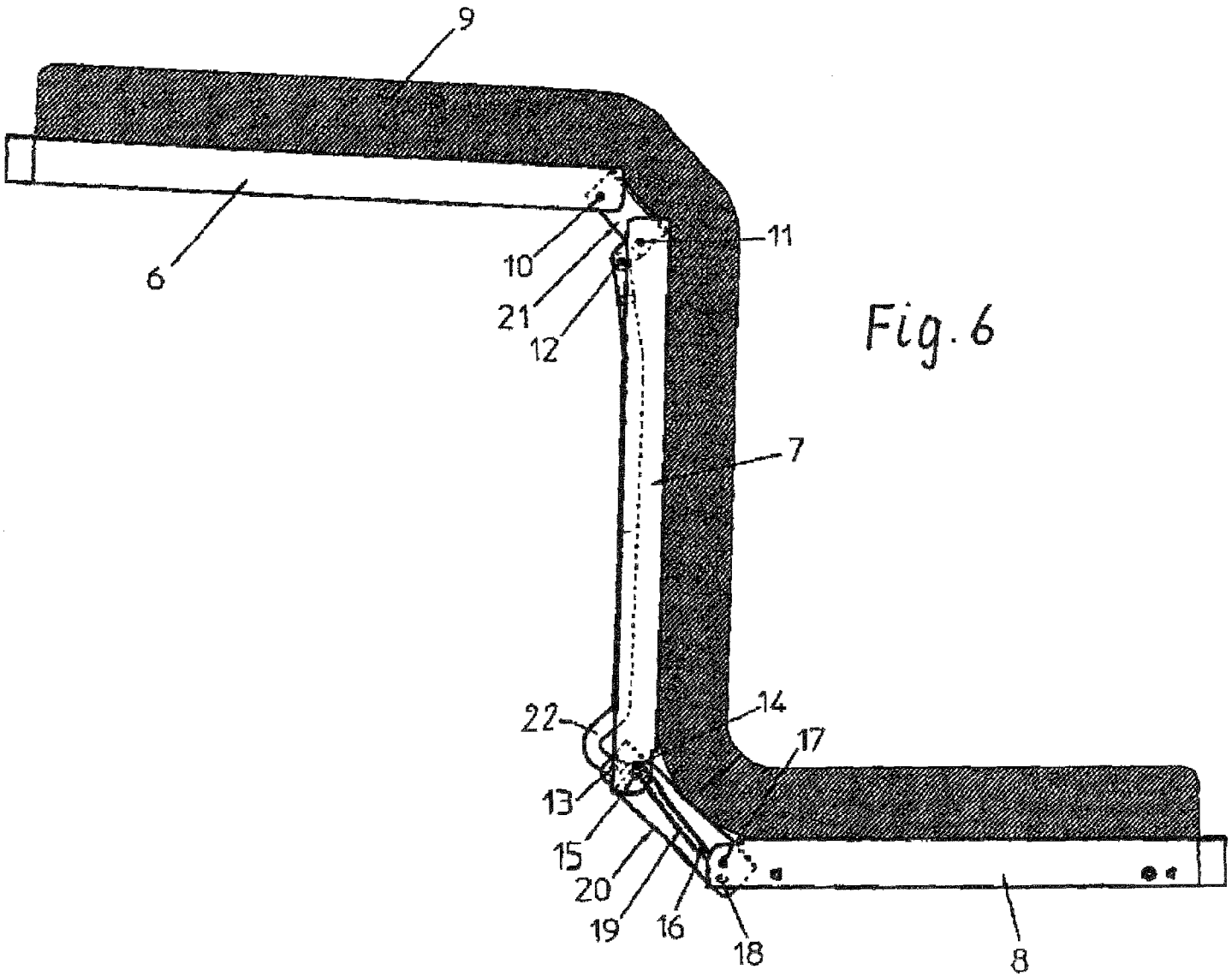
FIG. 6 shows a side view of the half folded lifting mechanism

FIG. 6 shows further details of the folding movements of the frames and their connectors.

Figure 7:
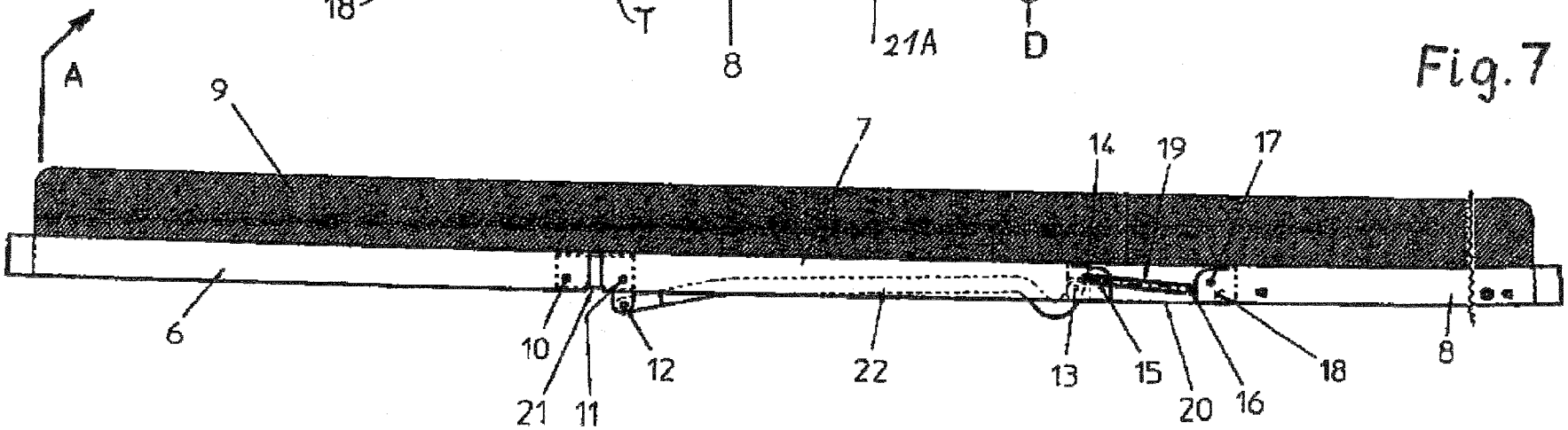
FIG. 7 shows a side view of the extended lifting mechanism with a detail of a frame connector.

FIG. 7 also shows, with an enlarged detail of the head frame connector 20, the frames 6-8 in the extended lying position. Apart from the frames and their connectors, as well as from the heads of the articulations, no fitting parts are exposed laterally. The spring 19 and the control rod 22 are inside the frame so there is no danger of pinching or of other injury. At the areas where the frames overlap with the connectors, limit stop areas are formed, so that the articulations cannot be moved beyond the extended position. Only a lifting of the bottom end in the direction of A initiates the folding to the bent shape according to FIG. 5.

Figure 8:
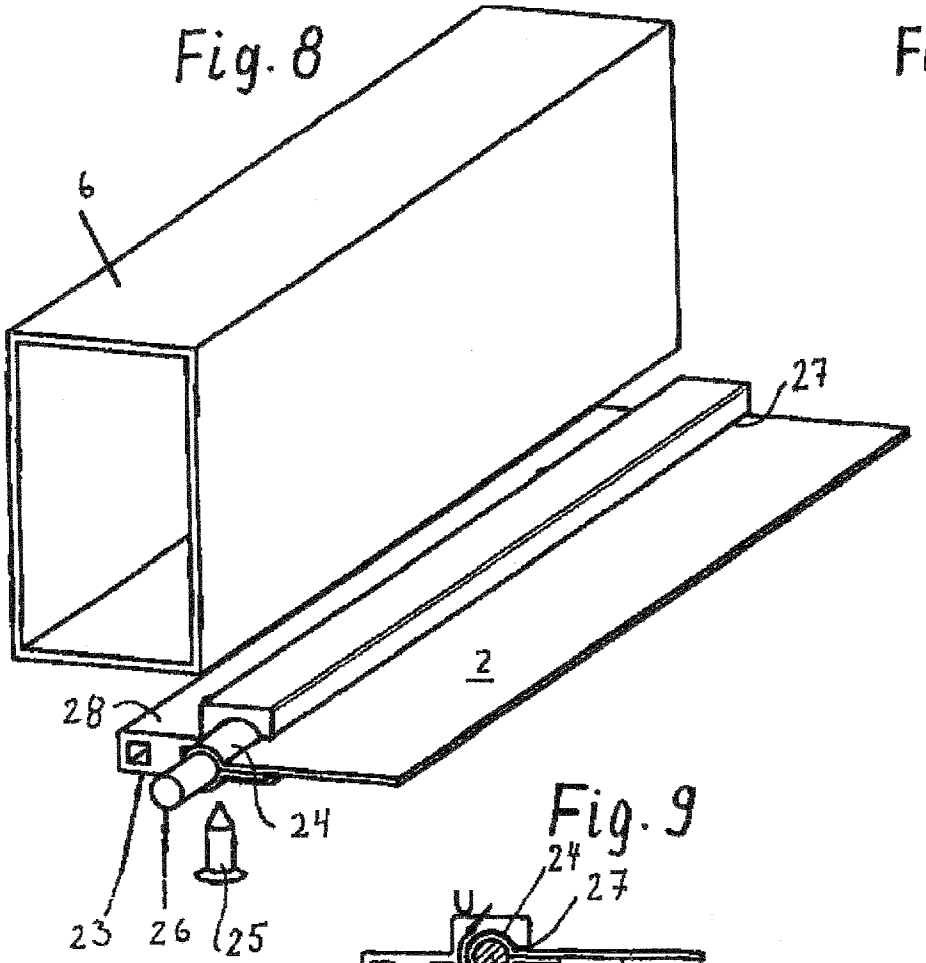
FIG. 8 shows a perspective exploded view of a mattress fastening.
Figure 9:
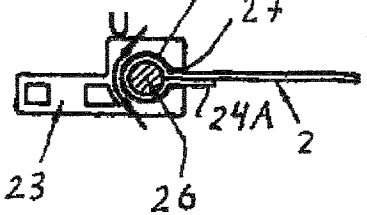
FIG. 9 shows a side view of FIG. 8 in detail.

FIGS. 8 and 9 show a partially exploded view, and a cross section respectively, of the support of the mattress on a mattress sling 2 or with a mattress truss. These are provided in their outside margins with a tuck 24, in which a fixing bar 26 is inserted. Both are inserted with a loose fit into a cylindrically undercut slot 27, with the free end of the tuck 24 placed in the slot 27 underneath the mattress sling 2.

The slot 27 is formed in a profile bar 23, which is attached, by means of a flange 28, to the frame tubular profile, for instance the profile of the foot frame 6, with screw connectors 25 or the like. Accordingly, if need be, upper straps of the mattress are also fastened to the frame, for example next to the fold in the range of the head frame connector 20, FIG. 5.

Figure 10:
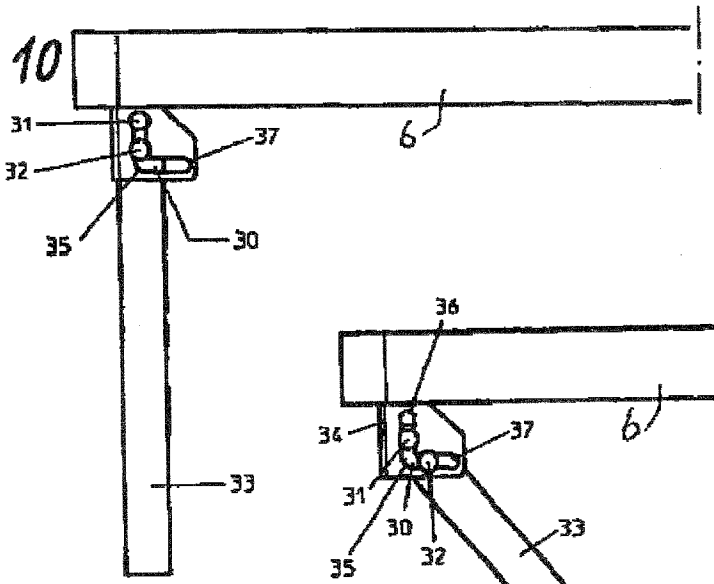
FIG. 10-12 show the bottom end with the bearing framework in three pivoted positions.
Figure 11:
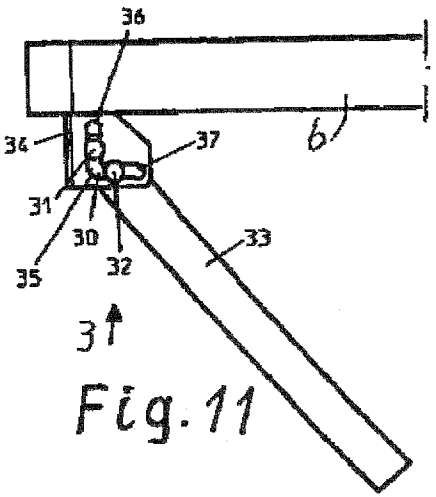
Figure 12:
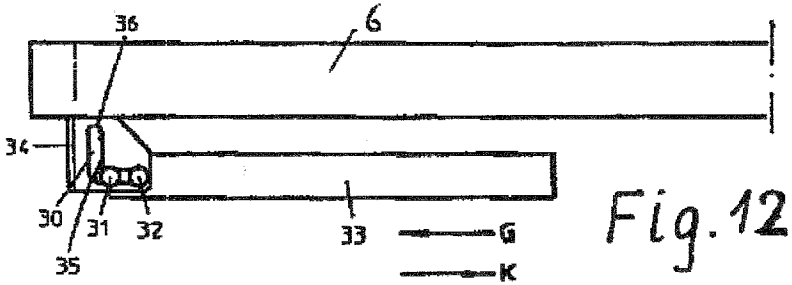

FIG. 10 to 12 show the pivot bearing of a leg 33 at the bottom end of the foot frame 6. An articulation head 34 with an articulation wall 30 is attached therein, with an angular motion link with a vertical branch 36 and a horizontal branch 37, which join in a corner 35. The horizontal branch 37 connects to the vertical branch 36 at the bottom and extends away from the bottom end. Two spaced superimposed bolts on the upright leg 33 extend through the motion link 36, 35, 37, said bolts being secured by bolt heads 31, 32 against extraction. The distance between the bolts is shorter than the length of each of the motion link branches 36, 37, so that the leg 33 in its vertical position—FIG. 10—is held stable against side forces, and in its horizontal position—FIG. 12—maintains this position accordingly. The motion link branch 37 is spaced from the foot frame 6 far enough to ensure a safety distance of at least one finger's breadth between the leg 33 and the foot frame 6.

FIG. 13-25 show a variant of the folding bed. The details shown there can also be advantageously combined with the previously described embodiment.

Figure 13:
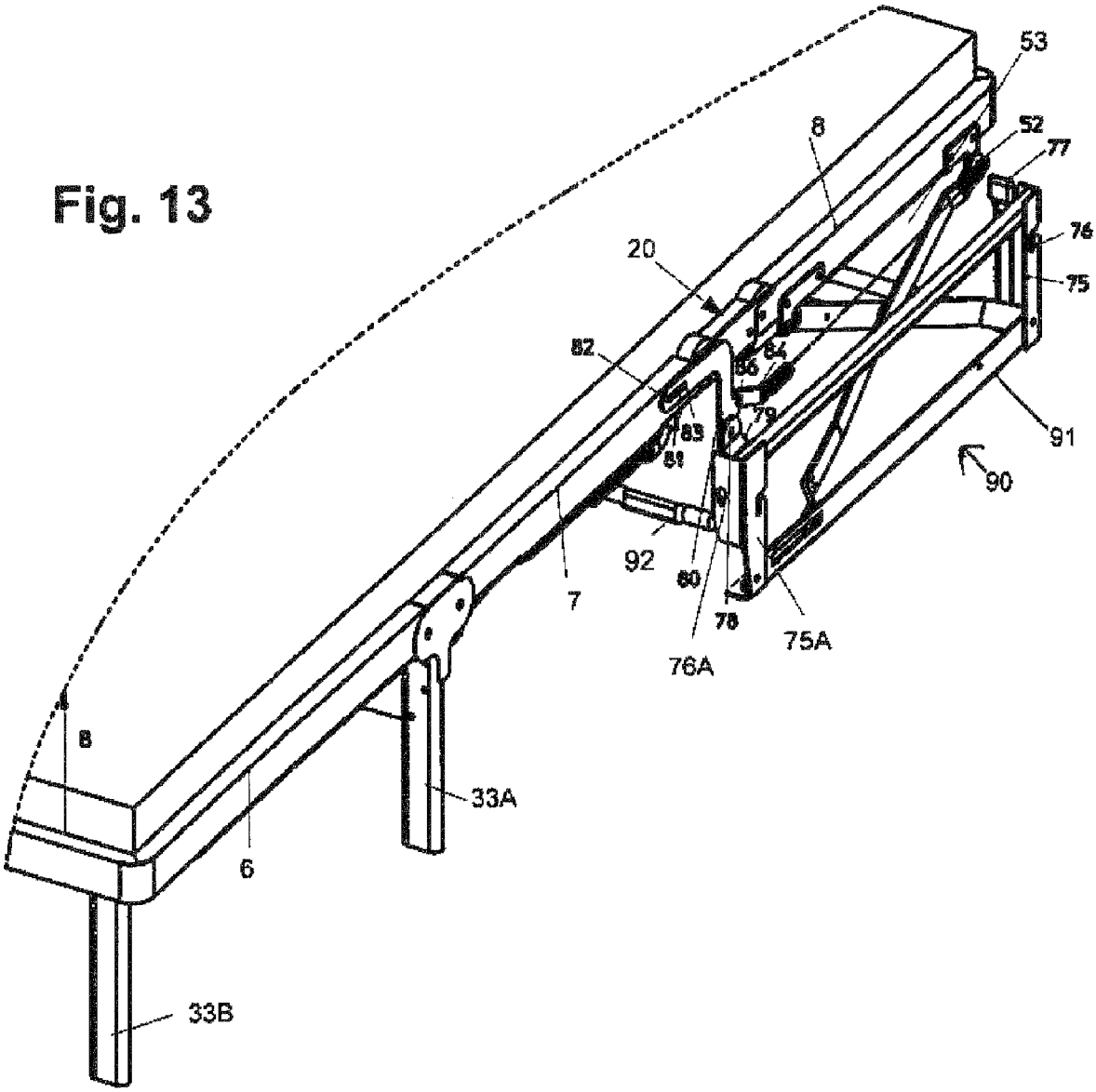
FIG. 13 shows one side of a variant of the unfolded bed, perspective view from the bottom end.
Figure 14:
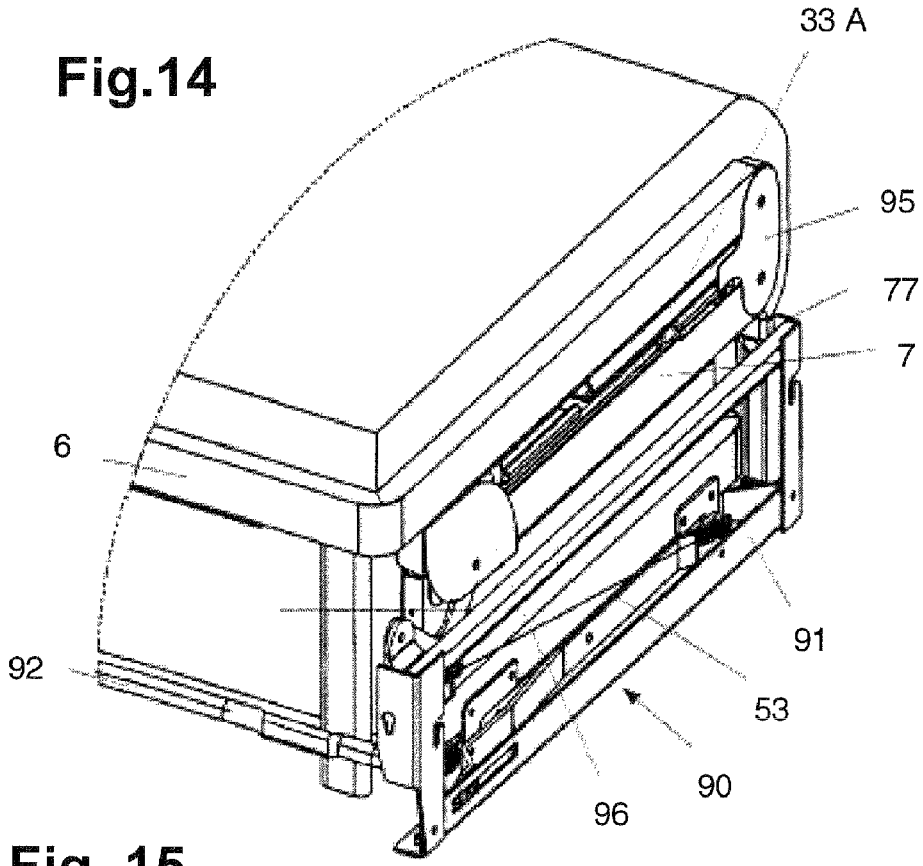
FIG. 14 shows one side of the folded bed of FIG. 13 view from the bottom end.

In FIG. 13 the bed, with a basic frame 90, is presented in the unfolded lying position, and FIG. 14 shows the collapsed seat position, respectively without arm or back frame and without cladding.

The basic frame 90 consists of side frames 91, which are composed of tubular and angular material and are interconnected from side to side with crossbars 92. The corner brackets 75, 75A of the side frames 91 have lateral angular notches 76 which serve to hold cap studs of cushion arm rests in order to attach them.

Furthermore, appropriate plug receivers for affixing the back cushion part are inserted at the corner bracket 75 in the back area, and correspondingly a notch 76A is positioned in the front sided corner bracket 75A for appending a front panel. At the top ends a link plate is attached with a bearing 78 for a boomerang-shaped support angle 80, which on the other end is articulated on the back frame 7 near the head frame connector 20.

At the end of the support angle near the bearing 78 a short angle appendix 79 with cranks 84, 86 is mounted, which is directed to the head end and connected with the scissors spring 53, which on the other end is attached to the rear articulation 52 of the scissors arm 48. In such a way the support angle 80 is held in its higher support position for the back frame 7. On the other hand, in the folded lying position, like FIG. 14 shows, the support angle 80 is held in the downward turned position by the spring 53.

The articulation of the support angle 80 on the back frame 7 consists of a stud 81, inserted in a slotted hole 82-83 parallel to the angle leg where it can be slid and rotated in a limited way. In the anterior end position 82 of the stud 81 the bed and scissors are stable in the lying position and securely held against sliding and bending. For folding, the stud 81 has to be actuated in the rear position 83 of the slotted hole by lifting the foot and back frame 6, 7, and then rotating the support angle 80, so that the scissors 47, 48 begin to fold in. Only then the frame connectors 20, 21 can be folded, as described with the first described variant.

For a further stabilization of the two folding positions, the legs at bottom end 33B are firmly connected with the foot frame 6. In folded state, the legs 33B stand behind the basic frame crossbar 92 within the basic frame 90 on the floor and there support the foot frame 6 firmly, as FIG. 14 shows.

In addition, the rear end of the back frame 7 in folded condition rests on a basic frame support 77. This support 77 catches in an elastic manner with the back frame 7.

The connectors 20, 21 of the frames 8, 7; 7, 6 are provided with protective caps 95, 96, 97, which in FIG. 23-25 are shown in enlarged diagram. They are made of plastic with extruded catch cones 95A, 97A, which can be unfastened only with tools, so that a secure protection is given against contact with the movable parts enclosed therein or underneath. An angular catch 95B at the protective cap 95 of the foot frame connector 21, directed towards the inner side of the bed, prevents interference in the access area of the foldable leg 33A, as FIG. 15 shows in addition.

FIG. 15 shows another locking mechanism composed of an elastic fork 61 and a correspondingly situated crossbar 62 of the back frame 6, said fork being attached at a horizontal corner sheeting 60 at the foot frame 6 next to the leg at the bottom end 33B. The two catch parts 61, 62 align the two frames 6, 7 in the complete collapsed position at a fixed distance, which is independent of the thickness of a covering mattress.

Figure 16:
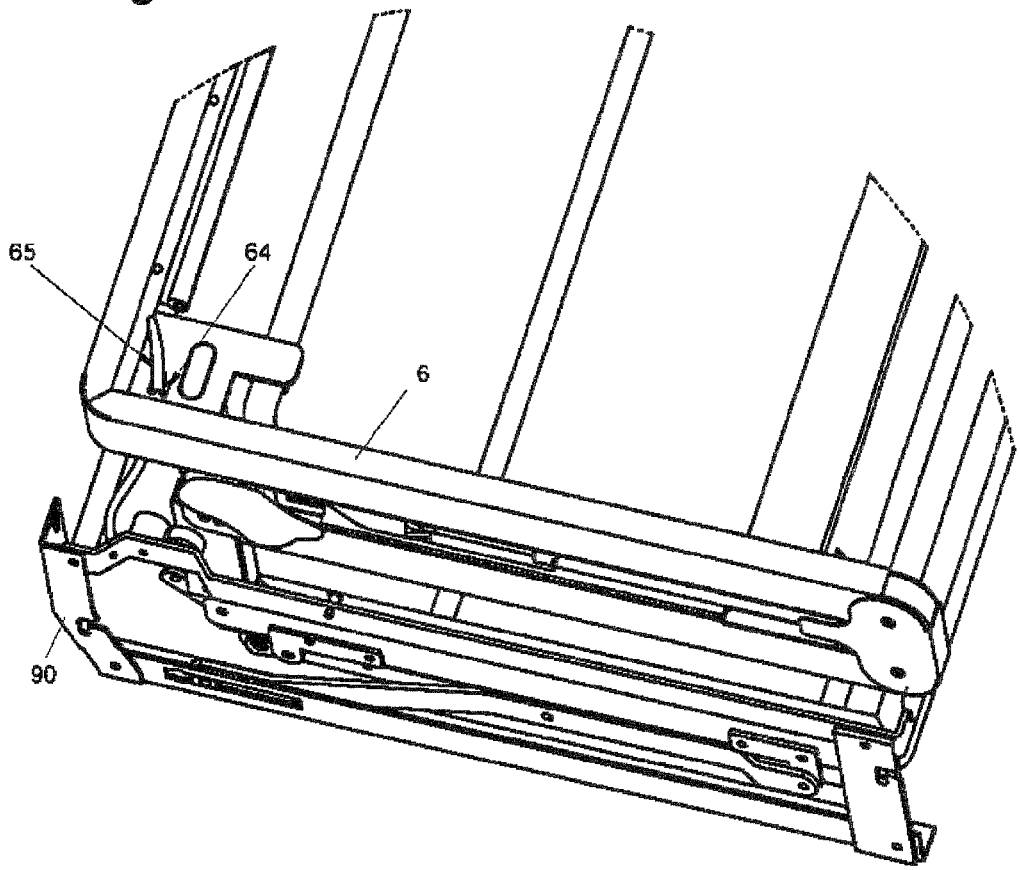

FIG. 16 shows a further detail at the bottom end of the foot frame 6. A catch hook 64 is arranged there, in the corner area above the leg, said hook, via an elastic appendix 65, connected to the basic frame 90, causing a latching in the folded state. As a consequence, the folded foot frame 6 is connected to the basic frame 90 on all sides in a releasable catch.

FIG. 17 shows a further embodiment of the head frame connector 20A, which has no leg. It consists of angular material, and is provided with a cladding 98 at its open side and a protective cap 97 on its articulation parts. This way the joint spring 19, FIG. 5, is completely enclosed.

FIG. 18 shows a different embodiment of the foot frame connector 21B, in one piece, with detached cladding. An attach shank T1 for the connection of the leg is also mounted, including rivet drill holes.

The two frame supports T3 have the form of a female connector and are vaulted by protecting and stiffening bends S1, S2. In the strutted bends attach drill holes S3 are formed for the cladding pins. The appendix T8 extends parallel to the attach shank T1, comprising mounting drill holes T5, T2 for locking parts.

On the other side of the shank T1 an attachment aperture T6 for an articulation 71 of a damper 72 is inserted, said aperture being reinforced by the bend S2. FIG. 19 shows the positioning of the damper 72. At its other end 70 the damper is articulated to the foot frame 6, and slows down the unfolding and folding of the foot frame 6, especially in the position of FIG. 6, which serves to protect users when they disengage the frame.

Figure 20:
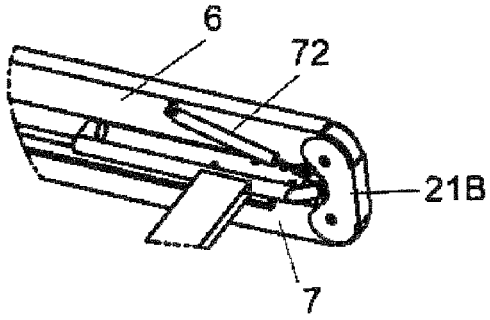

FIG. 20 shows the folded condition of the frames 6, 7 with the intermediate leg 33A and the damper 72 inside.

Figure 22:
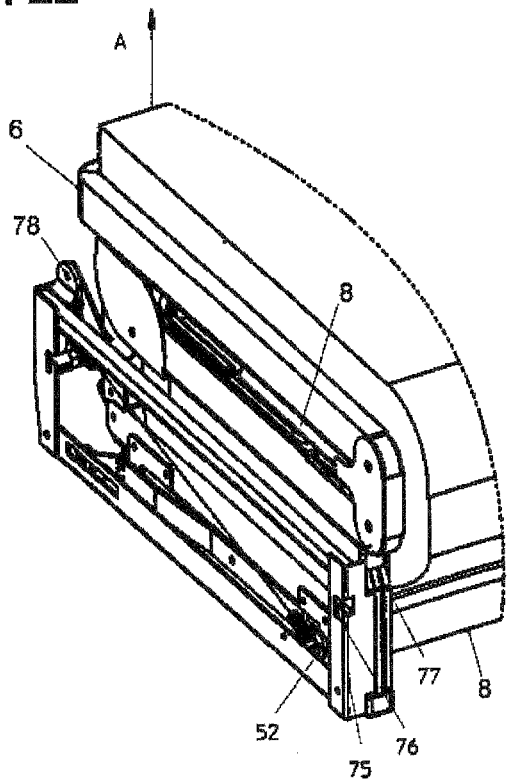

FIGS. 21 and 22 show the previously described details from other perspectives with the same references.

FIG. 26 shows an exploded perspective of the bed folded to a seat B without cushion side parts, but with detached back cushion part P. This part is formed as a hollow body, so that it encompasses a storage space for blankets or the like. The padded back plate P1 at its bottom end is articulated to a frame connecting wall P3 with a joint P2.

List of Reference Signs

0 load direction
1, 90 basic frames
2 mattress sling
3 bearing rack
4 lifting mechanism
6 foot frame
7 back frame
8 head frame
9 mattress
10 articulation 6-21
11 articulation 7-21
12 articulation 22-21
13 articulation 22-20
14 attachment eye 19 to 7
15 articulation 7-20
16 attachment eye 19 to 20
17 articulation 20-8
18 stop in extended position 20/8
19 joint spring
20, 20A head-frame connectors 7-8
21, 21A, 21B foot frame connectors 6-7
22 control rod
23 profile bar
24 tuck of 2
25 screw connector
26 fixing bar
27 slot
28 flange
29, 29A cross brace
30 wall of the articulation
31, 32 bolt heads
33, 33A, 33B leg
34 articulation head
35 corner of the motion link
36, 37 side pieces of the motion link
41 control arm at 20 for 42
42 link plate at 41 and 44
43 block link
44 articulation 43 to 47
45 articulation 42-41
46 articulation 43 to 8
47 first scissors arm
48 second scissors arm in the swivel bearing
49 articulation 8-20 and 41
49-46-44-45 four-bar linkage
50 scissors articulation 1-47
51 scissors articulation at 8
52 scissors articulation
53 scissors spring
54, 55 spring eyelets
56 glider 1-48
60 corner sheeting
61 elastic fork} locking mechanism
62 crossbar} locking mechanism
64 catch hook} locking mechanism
65 elastic appendix} locking mechanism
70 absorber bearing
71 articulation
72 absorber
75, 75A corner brackets
76, 76A notches
77 basic frame support
78 bearing for 80
79 angle appendix
80 support angle (boomerang)
81 stud
82, 83 slotted hole
84, 86 cranks
90 basic frame
91 side frame
92 crossbars of the basic frame
95, 96, 97 protective caps
95A, 97A connector pins at 95 and 97 respectively
95B appendices to 95
98 cladding
99 protective hood
B seat bench
P part of back cushion
P1 back plate
P2 articulated joint
P3 frame connecting wall
S1, S2 protecting stiffening bend
S3 attach drill holes
T1 attach shank
T2, T5 fixing drill
T3 frame bearing
T4 support bearing
T6 attachment aperture
T8 appendix
TZ expansion force

The invention claimed is:

1. Folding bed, covered with a mattress (9) and comprising a head frame (8), back frame (7), and foot frame (6) which are connected to one another in an articulated manner and are arranged in a collapsed state in a basic frame (1) or box such that they can be raised and lowered by means of a lifting mechanism (4), characterized in that the lifting mechanism (4) comprises scissors-type lifting arrangements, spring-loaded for lifting action, which are provided on both sides of the head frame (8) respectively, a first scissors arm (47) of each lifting arrangement being articulated, at the bottom end, on the basic frame, where a horizontally movable second scissors arm (48) is supported, the top end of which is articulated at the end of the head frame (8), and that the first scissors arm (47) is articulated, at its top end, on a short block link (43) at the back-part head-frame end with an articulation (44) on which acts a link plate (42) which is connected in an articulated manner to a control arm (41) and is connected to a spacing head frame connector (20) of the head frame (8) and of the back frame (7), and is arranged in such a way, that when the head frame connector (20) is brought to a horizontal position, the block link (43) is in a dead-centre position of the scissors articulation (44), and that when the connector is in an inclined position the block link (43) is lead out from the dead-centre position, so that the lifting mechanism (4) holds the head frame (8) in a lowered position.

2. Folding bed according to claim 1, characterized in that a scissors spring (53) is, with one end, mounted at the top end of the head frame and, with the other end, at the link-side of the first scissors arm (47).

3. Folding bed according to claim 1, characterized in that the head frame connector (20) has a length that corresponds approximately to a double thickness of the mattress (9).

4. Folding bed according to claim 1, further comprising at least one foot frame connector (21) articulated between the back frame (7) and the foot frame (6) a foot frame connector (21) to provide a distance of at least the width of a finger between the two frames (7, 6) in a parallel folded state.

5. Folding bed according to claim 4, characterized in that between the head frame connector (20) and the foot frame connector (21) a control rod (22) is in each case articulated in such a way that a four-bar linkage with the back frame (7) is formed, which in the collapsed condition of the bed is in a locking position against an expansion force (T) of the mattress (9) folded in between the head frame (8) and the back frame (7), and that the articulation (12) of the control rod (22) is arranged at the foot frame connector (21) at a sticking-out handlebar (21A) so that the locked position is released by pivoting the bottom end of the foot frame (6).

6. Folding bed according to claim 5, characterized in that the control rod (22) is arranged within the foot frame (6) and back frame (7).

7. Folding bed according to claim 4, wherein the at least one foot frame connectors comprises two foot frame connectors (21), wherein each foot frame connector (21) has one leg (33A) mounted thereon in such a way, that it has approximately a finger's breadth of distance to the foot frame (6) when folded.

8. Folding bed according to claim 4, characterized in that a plurality of legs (33, 33A) are arranged within the back frame (7) when folded.

9. Folding bed according to claim 1, characterized in that a folding spring (19) pulls the back frame (7) towards the head frame connector (20).

10. Folding bed according to claim 9, characterized in that the head frame connector (21A) is built of a profile material, which at its free side is covered by a protective cap (98) and, at its articulations, by a protective hood (99), in such a way that the spring (19) is kept inside.

11. Folding bed according to claim 9, characterized in that the folding spring (19) is arranged within the frames (6, 7).

12. Folding bed according to claim 1, characterized in that the mattress (9) and/or a mattress sling (2) in their outside margins are each provided with a tuck (24), and into the tuck (24) a fixing bar (26) is inserted, and the tuck (24) with the fixing bar (26) is plugged in an undercut slot (27) of a profile bar (23), which is attached to one of the foot frame (6), back frame(7), and head frame(8).

13. Folding bed according to claim 1, characterized in that at each side of the bottom end of the foot frame (6) respectively one articulation head (34) is arranged, in which respectively one leg (33) is held in an angled motion link (35, 36, 37) with two bolts (31, 32) so that the leg (33) is capable of being pivoted and locked.

14. Folding bed according to claim 13, characterized in that the motion link (35, 36, 37) has a vertical side piece (36) whose length is in each case bigger than a bolt spacing of the bolts (31, 32), which are arranged at a distance one above the other when the leg (33) stands upright.

15. Folding bed according to claim 13, characterized in that the leg (33) which is held horizontally in a horizontal side piece of the motion link (37) has a distance of approximately a finger's breadth to the foot frame (6), said horizontal side piece being attached to the bottom end of the vertical side piece of the motion link (36).

16. Folding bed according to claim 13, characterized in that both legs (33) are connected by a cross brace (29).

17. Folding bed according to claim 1, characterized in that on each side of the bottom end of the foot frame (6) respectively one leg (33B) is firmly mounted.

18. Folding bed according to claim 1, characterized in that the basic frame (90) is composed of side frames (91) on both sides, which consist of angular material connected with cross-bars (92).

19. Folding bed according to claim 18, characterized in that side frames hold notches (76, 76A) to append side, back and front cushion parts, as well as bearings (78), supports (77) and catching appendices (65), to the foot frame 6), back frame (7), and head frame (8) to further support and interlock them.

20. Folding bed according to claim 19, characterized in that a boomerang-shaped support angle (80) is mounted in the bearing (78), with a side piece which, when the bed is unfolded, is arranged parallel to the back frame (7), the side piece comprising a slotted hole (82, 83) being supported on the back frame (7) by means of a movable bearing stud (81), said angle also being connected to a scissors spring (53) by a link plate extending from the bearing (78) towards the top side, the other end of the spring being connected to the scissors articulation (52) at the head side.

21. Folding bed according to claim 19, characterized in that the supports (77) are mounted on the basic frame (90) with their top ends and, in the collapsed state, support a foot frame connector (21B) in a releasable catch.

22. Folding bed according to claim 21, characterized in that the foot frame connector (21B) contains an articulation piece, manufactured of one part, as well as the frame bearing in protecting stiffening bends (S1) and mounting holes (S3) for cladding pins (95A), an attach shank for a leg (33A) with fixing drill holes, an appendix, with fixing drill holes for locking parts, as well as an attachment aperture for an articulation (71) of a damper (72) reinforced by a bend (S2), said damper being articulated on the frame (6) at the other end.

23. Folding bed according to claim 21, characterized in that the articulation piece of the foot frame connector (21B) is clad with a protective cap (95) by means of connector pins (95A), and the protective cap (95) bearing appendices (95B), which cover the access area of a leg (33A).

24. Folding bed according to claim 19, characterized in that the catching appendices (65) are elastic and, by way of their position in the collapsed state, catch in a releasable connection with a catch (64) at bottom end of the foot frame (6).

25. Folding bed according to claim 19, characterized in that at the basic frame (90) a releasable cushion back part (P) can be attached, which contains a receiving space for blankets or the like, and whose back plate (P1) is articulated to a frame connecting wall (P3) with a joint (P2).

26. Folding bed according to claim 1, characterized in that at the bottom end of the foot frame (6) an elastic locking bracket (61) is arranged, which in the collapsed state encloses a crossbar (62) of the back frame (7) and holds the foot frame (6) at a distance.

* * * * *